United States Patent [19]

Satsuka et al.

[11] Patent Number: 4,945,191

[45] Date of Patent: Jul. 31, 1990

[54] CURLED ELECTRICAL CONDUCTOR CORD

[75] Inventors: Mamoru Satsuka, Osaka; Hironobu Furusawa, Ohtsu, both of Japan

[73] Assignee: Toyo Boseki Kabushiki Kaisha, Osaka, Japan

[21] Appl. No.: 227,679

[22] Filed: Aug. 3, 1988

[30] Foreign Application Priority Data

| | | | |
|---|---|---|---|
| Aug. 5, 1987 | [JP] | Japan | 62-195867 |
| Aug. 13, 1987 | [JP] | Japan | 62-202348 |
| Sep. 29, 1987 | [JP] | Japan | 62-244686 |
| Oct. 23, 1987 | [JP] | Japan | 62-268923 |
| Nov. 25, 1987 | [JP] | Japan | 62-296889 |
| Dec. 10, 1987 | [JP] | Japan | 62-313502 |
| Jan. 23, 1988 | [JP] | Japan | 63-13444 |

[51] Int. Cl.[5] ..... H01B 7/06; H01B 3/42

[52] U.S. Cl. ..... 174/69; 174/120 SR

[58] Field of Search ..... 174/69

[56] References Cited

U.S. PATENT DOCUMENTS

| | | | |
|---|---|---|---|
| 3,941,908 | 3/1976 | Valia et al. | 174/69 X |
| 3,953,650 | 4/1976 | Sauer et al. | 174/110 V X |
| 4,090,763 | 5/1978 | Congdon et al. | 174/69 X |
| 4,166,881 | 9/1979 | Congdon et al. | 174/69 X |

FOREIGN PATENT DOCUMENTS

| | | | |
|---|---|---|---|
| 3414913 | 10/1985 | Fed. Rep. of Germany | 174/69 |
| 58-1484 | 1/1983 | Japan . | |
| 62-17909 | 1/1987 | Japan . | |
| 1229442 | 4/1971 | United Kingdom | 174/69 |

*Primary Examiner*—Laramie E. Askin

*Attorney, Agent, or Firm*—Leydig, Voit & Mayer

[57] ABSTRACT

A curled electrical conductor cord is disclosed that comprises at least one core wire and a sheath layer covering the core wire, the core wire having at least one conductor covered with an insulating layer. The cord has a diameter of 1 mm or more, or has a cross-sectional area of 1 $mm^2$ or more. The vertical stretch $L_0$ of the curled portion of the cord by its own weight is 30% or less. The vertical stretch $L_{50}$ of the curled portion of the cord under a load of 50 g is 200% or more.

14 Claims, 4 Drawing Sheets

CURLED ELECTRICAL CONDUCTOR CORD

BACKGROUND OF THE INVENTION

1. Field of the Invention

This invention relates to a novel curled cord, and more particularly, it relates to a curled cord with excellent practicality for use, which is lightweight and compact, and has superior elasticity and restorability to its original configuration.

2. Brief Description of the Prior Art

A variety of conventional curled cords are known in which a conductor is covered with an insulating material, and then covered with a protective sheath material. For example, there are known curled cords with natural rubber or synthetic rubber used for the sheath material and curled cords with thermoplastic polymers used for the sheath material, such as vinyl chloride polymer, polyethylene, polyamide, polypropylene, and polyether.ester elastomers.

Also, the use of vinyl chloride polymer, polyethylene, polyamide, polypropylene, cross-linked polyvinyl chloride, cross-linked polyethylene, polyester.ether elastomers, etc., as insulating covering materials is known in the art.

The constitution and characteristics of curled cords suitable for use with telephones and the like have been disclosed in, for example, Japanese Laid-Open Patent Application No. 62-17909. The curled cords disclosed therein have a plurality of core wires comprising a conductor covered with an insulating material, the outside of which is further covered with a sheath layer made of, for example, a synthetic resin.

Also, a covered wire for the production of a curled cord with a small permanent stretch has been disclosed in Japanese Patent Publication No. 58-1484 that comprises as its basic material a polyester elastomer having a specific composition, that is, a specific copolyether ester elastomer.

In general, the basic functions of curled cords are:

(1) The capability to be stretched a moderate amount, (2) The capability to return satisfactorily to the form of a coiled spring, and (3) The property of not developing twists or reverse curls, so that the appearance is satisfactory.

Additional properties required are:

(4) Good insulating properties of the insulating covering layer, and (5) The capability of undergoing extrusion molding two times to form an insulating covering layer and a sheath layer.

At present, as a sheath material for curled cords that is generally used, soft vinyl chloride is mainly used in view of its pliability, workability, and cost. In order to improve the restorability of curled cords to their original configuration, the spring constant, the pliability at low temperatures, and the like, many references including the patent publication No. 58-1484 mentioned above give various suggestions, but a substitute for vinyl chloride has not been provided yet.

A curled cord with vinyl chloride polymer used for the sheath material is widely used because of its excellent economy and flame-retardance. However, such a curled cord has poor heat-resistance and the holding of its curl disappears at high temperatures. Thus, in certain circumstances, such cords do not serve as curled cords. In addition, the surface of such cords is readily stained, and the curl may stretch out gradually by its own weight. Also, because the capability to retain the curl is poor, the length of the curled cord may be too long when the cord itself is not being stretched.

A curled cord in which the sheath material is polyester.ether elastomer has advantages including excellent retention of its curl and superior restorability to its original configuration after being stretched. However, when the curled cord is colored a variety of colors other than black, and particularly when the colors are pale, the weather-resistance is unsatisfactory, and when used out of doors, particularly at high temperatures in direct sunlight, there is the problem that loss of function as a protective covering may occur. Such a curled cord has superior elasticity for a restoration to its original configuration, and excellent retention of its curl, but when a cord in curled configuration is going to be stretched out and used, much force is needed to stretch it. For example, when the cord is used for a telephone or the like, there is the disadvantage that the telephone will be pulled toward the user. Also, compared to vinyl chloride polymer, polyester.ether elastomer is flammable, which is a disadvantage.

Conventional curled cords have the superior qualities described above in a variety of their properties. However, there are problems in that the various properties listed below are not retained in good balance: that the retention of the curl needed for curled cords for practical use be good; that the restoration to its original configuration be excellent; that the curled cord can be stretched to an appropriate length by the use of a small amount of force; and that the cord has flame-retardant properties, excellent weather-resistance, and the like. Also, in order to provide a curled cord for practical use, it must be economical and have superior productivity.

SUMMARY OF THE INVENTION

The curled cord of this invention, which overcomes the above-discussed and numerous other disadvantages and deficiencies of the prior art, comprises at least one core wire and a sheath layer covering the core wire, the core wire having at least one conductor covered with an insulation layer, wherein the cord has a diameter of 1 mm or more, or a cross-sectional area of 1 $mm^2$ or more, and wherein vertical stretch $L_0$ of the curled portion of the cord by its own weight is 30% or less and vertical stretch $L_{50}$ of the curled portion of the cord under a load of 50 g is 200% or more.

In a preferred embodiment, the vertical stretch $L_0$ is 10% or less.

In a preferred embodiment, the conductor is composed of a plurality of solid wires with a diameter of 0.1 mm or less, or with a cross-sectional area of 0.01 $mm^2$ or less.

In a preferred embodiment, the insulating layer is made of crystalline copolyester with a melting point of 180° C. or more and Shore D hardness of 40 to 80.

In a preferred embodiment, the insulating layer is made of at least one selected from the group consisting of polyester.polyester block copolymer and polyester.-polyether block copolymer, the polyester.polyester block copolymer comprising crystalline aromatic polyester segments and polylactone segments, and the polyester.polyether block copolymer comprising crystalline aromatic polyester segments and aliphatic polyether segments.

In a preferred embodiment, the sheath layer is made of polyester elastomer.

In a preferred embodiment, the sheath layer is made of a composition comprising polyvinyl chloride and polyester elastomer, the proportion of the polyvinyl chloride being 50% by weight or more.

In a preferred embodiment, the sheath layer is made of a polyester elastomer composition with an oxygen index of 25.0 or more, and covering portions other than the sheath layer are made of a polyester elastomer composition with an oxygen index of 22.0 or more and modulus of impact resilience of 30% or more.

In a preferred embodiment, the sheath layer is made of a composition of polyester elastomer and halogenated polyolefin.

In a preferred embodiment, the insulating layer has a thickness of 0.1 mm or more and comprises a polyester block copolymer with a melting point of 180° to 240° C., and wherein said sheath layer has a thickness of 0.2 mm or more and comprises a polyester.polyether block copolymer with Shore D hardness of 60 or less.

Thus, the invention described herein makes possible the objectives of (1) providing a curled cord with excellent practicality for use, which can be employed for telephones, various apparatus for office automation, electric appliances for domestic use, audio products, wiring, and the like; (2) providing a curled cord with an excellent retention property of curl, which cord is short when not being stretched, which can be stretched with a small amount of force, and which can return to the original configuration in a short time when the force pulling it is removed; (3) providing a curled cord that has excellent weather-resistance and flame-retardant properties; and (4) providing a curled cord that can be readily produced by fusion molding of an insulating layer and a sheath layer, resulting in a relatively low cost of production.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
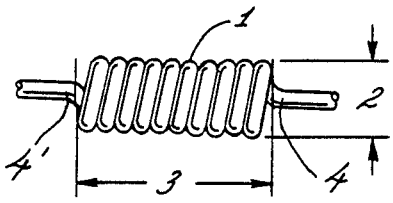
FIG. 1 is a schematic view of the curled cord provided in accordance with the present invention.
Figure 2:
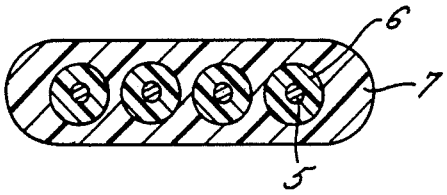
FIG. 2 is a sectional view of a preferred embodiment of the curled cord of the present invention.
Figure 3:
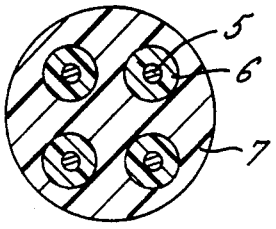
FIG. 3 is a sectional view of another preferred embodiment of the curled cord of the present invention.
Figure 4A:
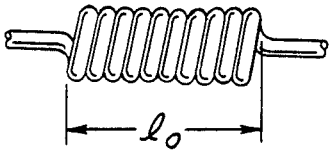
FIG. 4A is a schematic view of the curled cord provided in accordance with the present invention showing the situation in which the curled portion thereof is not being stretched.
Figure 4B:
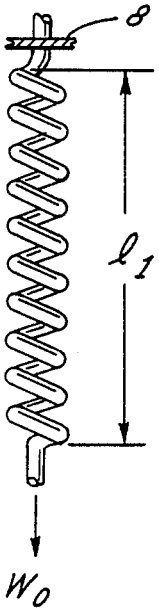
FIG. 4B is a schematic view showing the situation in which the curled portion of the cord shown in FIG. 4A is being stretched in the vertical direction by its own weight.
Figure 4C:
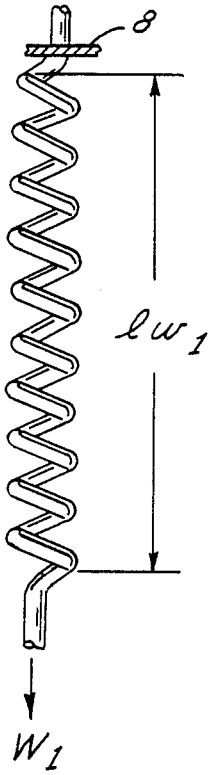
FIG. 4C is a schematic view showing the situation in which the curled portion of the cord shown in FIG. 4A is being stretched in the vertical direction under a load of $W_1$ g.

FIG. 1 is a schematic view of the curled cord 1 provided by the present invention. Here, reference numeral 2 shows the diameter of the curl; reference numeral 3 is the curled portion, and the length of this portion is the curl length; reference numerals 4 and 4' are the portions outside the curled portion, which are either at right angles or parallel to the axis of the curl, and which are essentially in the form of a straight line. A plug, connector, or the like can be attached to the edge portions outside the curled portion. FIGS. 2 and 3 show sectional views of various curled cords of this invention. Here, reference numeral 5 is the conductor, reference numeral 6 is the insulating layer, and reference numeral 7 is the sheath layer. FIG. 4A shows the situation in which the curled cord is allowed to be horizontal, so that the curled portion is not being stretched. The length of the curled portion at this time is $l_0$. FIG. 4B shows the situation in which one end of the curled cord is held in a fixed supporter 8, and in which there is no load placed on the other end except for the weight of the curled cord itself, so that the curled portion is being stretched by its own weight. The length of the curled portion at this time is $l_1$. FIG. 4C shows the situation in which the curled portion is being stretched by a load of $W_1$ that has been placed on one end of the curled cord as shown in FIG. 4B. The length of the curled portion at this time is $l_{w1}$. When $W_1$ is 50 g, this length is referred to as $l_{50}$, and when it is 100 g, this length is referred to as $l_{100}$.

The curled cord of this invention has a diameter of 1 mm or more when the cross-section is circular, or a cross-sectional area of 1 $mm^2$ or more when the cross-section is not circular. The curled cord of this invention has an insulating layer formed on the conductor, and a sheath layer to cover the insulating layer. Preferably, the thickness of the insulating layer and the sheath layer when measured together is 0.2 mm or more, and more preferably, 0.3 mm or more.

In general, the force needed when a curled cord is in use is on the order of 50 to 100 g, at which force the user will not feel much resistance by the curled cord. Thus, the curled cord will be practical for use only if the use of this amount of force results in a sufficient stretched length.

The curled cord of this invention is pulled by its own weight by the stretch $L_0$, which is 30% or less. That is, $L_0=[(l_1-l_0)/l_0]\times 100(\%)$ is 30 or less. Also, the stretch $L_{50}$ caused under a load of 50 g is 200% or more. That is, $L_{50}=[(l_{50}-l_1)/l_1]\times 100\ (\%)$ is 200 or more. This $L_{50}$ is preferably 300 or more, and more preferably, 400 or more. In addition, when the $L_0$ and $L_{50}$ are values to satisfy the conditions mentioned above, $L_{100}$ is 400 or more, and preferably 500 or more. A curled cord with an $L_0$ of 30% or less and an $L_{50}$ of 200% or more in which the insulating layer and the sheath layer are made to be thin can be prepared with natural rubber and the like. However, if both covering layers are made to be extremely thin, the durability of the curled cord decreases, and its usefulness also decreases.

Among the preferred conductors that can be used for the curled cords are those twisted from several thin wires, thin foil wires, or a combination thereof. Preferred are thin wires with a diameter of 0.1 mm or less and thin foil wires with a cross-sectional area of 0.01 $mm^2$ or less.

Among the insulating materials to cover the conductor are included polyester elastomers such as crystalline copolyesters with a melting point of 180° C. or more and Shore D hardness of 40 to 80, polyester.polyester block copolymers, and polyester.polyether block copolymers. These insulating materials all have excellent melt-covering properties.

With the copolymers mentioned above, the conductor can be covered uniformly and thinly. Thus, it is possible to make the core wires thin, which lends the core wires the properties of elasticity and stiffness. These properties of the core wires have an effect on the qualities of the curled cord. The choice of core wires can be done to determine the configuration of curled cords, curling properties, spring properties, and the like.

When a polyester.polyester block copolymer is used, it is possible to obtain core wires with superior heat-resistance and elasticity. Because the heat-resistance of such core wires is excellent, it is easy to cover the core wires with the sheath material, and the curled cord obtained has superior elasticity. When a polyester.-polyether block copolymer is used, it is possible to obtain core wires with superior pliability. Such core wires are preferable because their use results in a curled cord with much pliability.

As has been described in the section under the heading "Description of the prior art" for the inventions of Japanese Laid-Open Patent Application No. 62-17909 and Japanese Patent Publication No. 58-1484, a copolyester.ether elastomer can be used to cover a conductor directly. When this kind of cord is heated, during the curling process, or when the curled cord obtained is used in a heated atmosphere, the polyether portion in the elastic covering is in contact with the metallic conductor, and so the conductor is rapidly damaged by being oxidized, which causes the durability to decline.

In order to overcome these disadvantages, it is preferable that crystalline copolyesters with a melting point of 180° C. or more and Shore D hardness of 40 to 80 be used, or else that polyester.polyester block copolymers be used. The reason is that the workability when the curl is being formed and the heat-setting properties of these materials are excellent, and the materials do not damage the stretchability of the curled cord.

The crystalline copolyesters with a melting point of 180° C. or more contain, as a major acid component, telephthalic acid or naphthalenedicarboxylic acid. Among other acid components include aromatic dicarboxylic acids such as isophthalic acid, orthophthalic acid, bis(p-carboxyphenyl)methane, and anthracenedicarboxylic acid; alicyclic dicarboxylic acids such as 1,4-cyclohexanedicarboxylic acid, cyclopentanedicarboxylic acid, and 4,4'-bicyclohexyldicarboxylic acid; and ester-formable derivatives thereof. Preferred are isophthalic acid and orthophthalic acid.

The crystalline copolyesters mentioned above contain, as a major alcohol component, ethylene glycol or 1,4-butanediol. Among other alcohol components include propylene glycol, neopentyl glycol, 1,5-pentanediol, 1,6-hexanediol, decamethylene glycol, and cyclohexane-dimethanol. Preferred are 1,6-hexanediol and cyclohexane-dimethanol.

Also, as a copolymer component of the copolyester of the present invention, polylactones can be used. Examples of the polylactones are addition polymers in which lactones are subjected to ring-opening polymerization with the crystalline polyester components, and copolyesters that are obtained by the copolymerization of lactones. Examples of the lactones that can be used include δ-valerolactone, ε-caprolactone, β-propiolactone, and 2,2-dimethyl-β-propiolactone.

According to the intended use of the curled cord, the insulating materials can contain heat stabilizers, UV light absorbers, pigments, fluorescent whitening agents, and carbon black.

A variety of materials can be selected for use as the sheath material of this invention, depending on the purpose of its use and its applications. When curling properties and pliability are particularly required, it is preferable to use a polyester elastomer with Shore D hardness of 60 or less. When heat resistance and resistance to aging by heat are particularly required, the use of polyester.polyester block copolymers is preferable.

Also, when flame-resistance is required, there can be used a blend of polyvinyl chloride and polyester elastomer, a blend of polyester.polyether block copolymer and halogenated polyolefin, polyester elastomer with a flame-retardant added, etc. As the sheath materials, those with an oxygen index of 25.0 or more are particularly preferred. In this case, it is preferable to use a polyester elastomer composition with an oxygen index of 22.0 or more and a modulus of impact resilience of 30% or more as the insulating material and as a covering material other than the sheath material.

An example of the sheath materials is a composition of polyvinyl chloride and a polyester.polyether block copolymer and/or a polyester.polyether block copolymer. This composition contains 50% by weight or more of polyvinyl chloride. Preferably, the ratio of polyvinyl chloride to polyester.polyester block copolymers and/or polyester.polyether block copolymers is in the range of 97:3 to 70:30 by weight, and more preferably 97:5 to 75:25 by weight.

If the proportion of polyvinyl chloride used is more than 97% by weight, the improving effects of the polyvinyl chloride will be small. If the proportion of polyester.polyester block copolymer and/or polyester.-polyether block copolymer is more than 30% by weight, there are the undesirable effects of a rise being necessary in the extrusion temperature; a decrease in the weather-resistance of the curled cord; a decrease in the flame-resistance properties; and an increase in the cost.

When flame-retardant properties are required, resins used in compositions for the formation of a sheath layer include polychloroprene, polyvinyl chloride, polyvinylidene chloride, polyvinylidene fluoride, chlorosulphonated polyethylene (HYPALON), chlorinated polyethylene (having a chlorine content in the range of 30 to 50%), and fluororubber (VITON). The resinous compositions can also contain optional ingredients such as flame-retardants, plasticizers, pigments, and binding agents. There can also be used resinous compositions comprising resins other than those mentioned above, the resinous compositions having an oxygen index of 25.0 or more. Such resinous compositions can be prepared by the addition of a flame-retardant to the resins or by the modification of the resins to make them flame-retardant.

The resinous compositions by which a sheath layer is formed have an oxygen index of 25.0 or more, preferably 28.0 or more, and more preferably 30.0 or more. The oxygen index is measured by the standard method that is well known in the art.

Because the covering properties of the sheath material are satisfactory, it is easy to manufacture thinner cords than before, and thus for the curled cords to be more compact than before, which makes it possible to obtain curled cords with a stable configuration, excellent curling properties, and excellent restorability to the original configuration.

When a polyester.polyether block copolymer is mixed with polyvinyl chloride, pliability and excellent curling properties are imparted to curled cords; when a polyester.polyester block polymer is mixed with polyvinyl chloride, stiffness and spring properties of the curl are imparted to curled cords, and the decrease in flame-resistance is small. Also, there are the advantages of superior resistance to aging by heat, weather-resistance, and the like.

In this invention, when the sheath material is different from the insulating material for the core wires, it is easy to connect the cord prepared with these materials because the sheath layer and the core wires are well separated. Thus, it is preferable to use as the sheath material a polyester block copolymer that is different from the insulating material of the core wires. As one example of a suitable combination, the insulating material of the core wires can be a polyester.polyester block copolymer, and the sheath material can be a polyester.-polyether block copolymer.

The polyester.polyester block copolymer that can be used as the insulating material and the sheath material of this invention comprises crystalline aromatic polyester segments and polyester lactone segments. The block copolymer can be obtained, for example, by the reaction of a crystalline aromatic polyester with a lactone. The crystalline aromatic polyester mentioned above is a polymer that has mainly ester bonds, or has both ester bonds and ether bonds, and that contains at least one aromatic group in the main repeating units, and hydroxyl groups at the ends of the molecule. Preferably, the crystalline aromatic polyester is a polyester that has a melting point of 150° C. or more when a high polymer is to be formed therefrom. The preferred molecular weight of the polyester is 3000 or more.

Preferred examples of the polyester.polyester block copolymer are homopolyesters such as polyethylene terephthalate, polytetramethylene terephthalate, poly-1,4-cyclohexylenedimethylene terephthalate, and polyethylene-2,6-naphthalate; polyester.ethers such as polyethylene oxybenzoate, and poly-p-phenylene bisoxyethoxyterephthalate; and copolyesters or copolyester.ethers that comprise tetramethylene terephthalate units or ethylene terephthalate units as major units, and that also contain copolymerizable components such as tetramethylene or ethylene terephthalate units, tetramethylene or ethylene adipate units, tetramethylene or ethylene sebacate units, 1,4-cyclohexylenedimethylene terephthalate units, and tetramethylene or ethylene p-oxybenzoate units. When copolymers are used, it is desirable that they should contain 60 mole% or more of tetramethylene or ethylene terephthalate units.

Among the lactones include ε-caprolactone, which is most preferable, enantholactone, and γ-caprylolactone; two or more of the lactones can also be used.

The ratio of aromatic polyesters to lactones can be selected according to convenience from the range of 97:3 to 5:95 by weight. For a curled cord the use of which requires strength, it is desirable to select ratios within the range of 95:5 to 70:30 by weight. For a curled cord the use of which requires pliability and flexibility, the preferred ratio falls in the range of 80:20 to 60:40 by weight.

The polyester.polyester block copolymer mentioned above can be prepared through the reaction of a heat-melted mixture of a crystalline polyester and a lactone. At this time, a catalyst may or may not be used.

The polyester.polyether block copolymer used in the present invention comprises crystalline aromatic polyester segments and aliphatic polyether segments. The crystalline aromatic polyester segments comprise ester units consisting of dicarboxylic acids, most of which are aromatic dicarboxylic acids with a molecular weight of less than 300, and glycols with a molecular weight of less than 250. The aliphatic polyether segments comprise polyalkylene glycols with a molecular weight of 400 to 6000.

As the dicarboxylic acid contained in the crystalline aromatic polyester segments, there can be used an aromatic dicarboxylic acid with a molecular weight of less than 300 such as terephthalate acid, isophthalic acid, phthalic acid, 2,6- or 1,5-naphthalenedicarboxylic acid; an alicyclic dicarboxylic acid such as 1,4-cyclohexanedicarboxylic acid; an aliphatic dicarboxylic acid such as oxalic acid, glutaric acid, adipic acid, azelaic acid, sebacic acid, and any of the dimeric acids. Also used are mixtures of these dicarboxylic acids.

As the glycol with a molecular weight of less than 250 that is contained in the crystalline aromatic polyester segments, there can be used an alkylene glycol such as ethylene glycol, 1,2- or 1,3-propylene glycol, 1,4-butanediol, neopentyl glycol, and 1,6-hexanediol, and a cycloalkylene glycol such as 1,4-cyclohexanedimethanol. Also used are mixtures of these glycols.

Preferred examples of the crystalline aromatic polyester segments include homopolyesters such as polybutylene terephthalate and polyhexamethylene terephthalate, and copolyesters such as polybutylene terephthalate/polybutylene phthalate, polybutylene terephthalate/polybutylene isophthalate, polybutylene terephthalate/polybutylene sebacate, polybutylene terephthalate/polyhexamethylene isophthalate, and polyethylene terephthalate/polyethylene isophthalate.

As the polyalkylene glycol with a molecular weight of 400 to 6000 that is contained in the aliphatic polyether segments, there can be used polyethylene glycol, poly(1,2- or 1,3-propyleneoxide)glycol, poly(tetramethyleneoxide)glycol (PTMG), and a copolymer of ethylene oxide and propylene oxide. The polyalkylene glycol has a molecular weight of 400 to 6000, and preferably 500 to 4500. Mixtures of the polyalkylene glycols can also be used.

Preferred examples of the aliphatic polyether segments include poly(tetramethyleneoxide)glycol.

The ratio of crystalline aromatic polyester segments to aliphatic polyether segments in the polyether.-polyether block copolymer are in the range of 90:10 to 10:90 by weight. It is not preferred that the proportion of crystalline aromatic polyester segments is more than 90% by weight because polyalkylene glycol units as polymer components with a low glass transition temperature (Tg) are decreased, so that the copolymer cannot have improved low-temperature characteristics. It is not desirable that the proportion of crystalline aromatic polyester segments is less than 10% by weight because of properties that give rise to hard segments of the copolymer.

The polyester.polyether block copolymer can be prepared by any of the well-known techniques. An example of the preferred preparation will hereinafter be described. By use of an excess of low-molecular-weight glycols and poly(alkyleneoxide) glycols, the number of moles of the glycols being about 1.2 to 2.0 times that of dicarboxylic acids, transesterification of the dimethyl esters of dicarboxylic acids is conducted at a temperature of about 150° to 260° C. under atmospheric pressure in the presence of an ordinary catalyst for esterification. At this time, methanol is distilled away, and then the reaction mixture is heated to 200° to 270° C. under reduced pressure of more than 5 mmHg to cause polycondensation thereby. When necessary, a certain amount of cross-linkable components can be incorporated into the polyester.polyether block copolymer, resulting in an improvement of properties thereof. For example, it is possible to improve the elastic properties of the copolymer by the use of polycarboxylic acids and polyols, or polyoxy acids, all of which have three functionalities or more, as a part of the copolymerizable components.

The polyester block copolymer used in the present invention can be blended with epoxides, carbodiimides, isocyanates, oxazolines, alkaline metal salts of aliphatic polycarboxylic acids, etc., according to the purpose (to improve heat-resistance or water-resistance, to increase viscosity, or the like).

As a covering material used for layers other than a sheath layer, a thermoplastic elastomer can be used that has a modulus of impact resilience of 30% or more and an oxygen index of 22.0 or more. The modulus of impact resilience is measured according to JIS.K6301. Examples of the thermoplastic elastomer include polyester elastomers (e.g., R90AFR3 and R90AFR4 available from Toyo Boseki K.K.), and other elastomers of flame-retardant grade with an oxygen index of 22.0 or more, such as polyurethane, polyolefin rubber, and styrene block polymer. These elastomers of flame-retardant grade can be used either alone or in the form of a mixture thereof. There can also be used a mixture of such elastomers with the resins used for a sheath layer provided that the mixture meets the requirements for covering materials used for layers other than a sheath layer. Among these, elastomers of polyester block polymers are particularly preferred because of good productivity and restorability to the original configuration.

The invention will be further illustrated by the following Examples, but is not limited thereby in any manner.

EXAMPLES

Example 1

A conductor consisting of 30 soft copper wires (with a diameter of 0.05 mm) twisted together was used, and this conductor was covered with polyester.ester elastomer (PEL: S6001 available from Toyo Boseki K.K.) by fusion extrusion. The thickness of the insulating layer was 0.2 mm. Four of these conductors covered with the insulating material were put together, and the combined conductors were covered with polyester.ether elastomer (PEL:40H available from Toyo Boseki K.K.) by fusion extrusion, which formed a sheath layer. The thickness of the sheath layer was about 1.0 mm. The cord obtained had a diameter of 2.5 mm. This cord was wound around a cylinder with the diameter of 8 mm, and then heat-treated to give a curled cord.

This curled cord was cut so that the curl length $l_0$ would be 20 cm. The properties of the curled cord were measured, and the results are shown in Table 1.

TABLE 1

| | $L_0$ (%) | $L_{50}$ (%) | $L_{100}$ (%) |
|---|---|---|---|
| Example 1 | 5.2 | 430 | 795 |
| Comparative Example 1-1 | 36.8 | 170 | 295 |

Comparative Example 1—1

A curled cord was prepared in the same way as in Example 1, except that polypropylene was used for the insulating layer, and vinyl chloride polymer was used for the sheath layer.

The properties of the curled cord were measured in the same way as in Example 1, and the results are shown in Table 1.

Comparative Example 1-2

A curled cord was prepared in the same way as in Example 1, except that the conductor comprised a combination of 4 soft copper wires (with a diameter of 0.8 mm). The cord obtained had a diameter of 4.0 mm. This curled cord was cut so that its $l_0$ would be 20 cm, and its properties were evaluated. $L_0$ was 2.8%, but $L_{50}$ was 100% or less, so the curled cord was stiff, and it was not readily stretched by the application of a small amount of force.

Comparative Example 1-3

A curled cord was prepared in the same way as in Example 1, except that the conductor comprised a combination of 15 soft copper wires (with a diameter of 0.05 mm) and that the thickness of the insulating layer was 0.08 mm and the thickness of the sheath layer was 0.1 mm. The outer diameter of the cord was 0.9 mm. This curled cord was cut so that its $l_0$ would be 20 cm, and its properties were evaluated. $L_0$ was 4.9%, and $L_{50}$ was 550%. This curled cord could readily be stretched by the application of a small amount of force. However, when the curled cord was stretched to the extent of 300% and allowed to return many times, the restorability to the original configuration became poor in a short period of time, resulting in an increase of $l_1$. Also, cracks appeared in the sheath layer.

Example 2

In this Example, the following block copolymers A and B were used as the insulating material. Polybutylene terephthalate and ε-caprolactone were reacted to yield a polyester.polyester block copolymer A (containing 15% by weight of polycaprolactone and 85% by weight of polybutylene terephthalate; melting point, 225° C.; reduced specific viscosity, 1.95); a polyester.-polyether block copolymer B (containing 60% by weight of polytetramethylene oxide glycol and 40% by weight of polybutylene terephthalate; melting point, 175° C.; reduced specific viscosity, 1.90) was prepared from polybutylene terephthalate and polytetramethyleneoxide glycol (having a number average molecular weight of 1100). As the conductor, copper wires twisted together to give the outer diameter of 0.3 mm were used. The polyester block copolymers were extrusion-molded around the outside of this conductor, and core wires with a diameter of 0.6 mm were obtained. Next, four such core wires were put together, and the sheath material shown in Table 2 below was extruded to give a cord with the diameter of 2.5 mm. This cord was wound around a cylinder with the diameter of 6 mm, fixed in place, and heat-treated at 140° C. for 30 minutes. This produced a curled cord with an outer diameter of curl of 11 mm. In the same way, a variety of curled cords were prepared by the use of polyethylene (PE) or polyvinyl chloride (PVC) as the insulating material, and polyvinyl chloride as the sheath material.

The curled cords obtained were compared for their characteristics and the results ade shown in Table 2.

TABLE 2

| | | | No. 1 | 2 | 3 | 4 | 5 |
|---|---|---|---|---|---|---|---|
| Insulating materials | Block copolymer | | A | B | — | — | — |
| | Other | | — | — | PE | PVC | PE |
| Sheath materials | PVC (parts) | | 75 | 75 | 75 | 75 | 100 |
| | Block copolymer (parts) | | B:25 | A:25 | A:25 | A:25 | — |
| Length of the curled portion | Horizontal free length $l_0$ | Initial (mm) | 180 | 180 | 180 | 180 | 180 |
| | | 30 min after the weight test[1] (mm) | 180 | 180 | 260 | 280 | 300 |
| | Vertical length under its own weight $l_1$ | Initial (mm) | 230 | 230 | 230 | 240 | 250 |
| | | Just after the weight test[1] (mm) | 460 | 430 | 700 | 900 | 1100 |
| Vertical length under a 50 g weight, $l_{50}$ (mm) | | | 900 | 1000 | 480 | 560 | 330 |
| Bend test[2] (times) | | | 10,000 or more | 10,000 or more | 5000 or less | 5000 or less | 5000 or less |

[1]After a weight of 380 g was used, the weight was removed.
[2]The bend test is done by bending a cord over a 360° angle with a 500 g weight at the rate of 20 times/min while a 0.2 A current is being passed through a conductor of the cord at the voltage of 20 V and measuring the number of bends needed to break the conductor in two.

Example 3

The manufacture of as compact curled cords as possible was attempted by every combination of the insulating materials and sheath materials of Example 2.

It was easy to manufacture curled cords with a diameter of 2.0 mm by the use of materials shown in Nos. 1 and 2 of Table 2. In this case, it was possible to manufacture a curled cord with a horizontal free length $l_0$ of 120 mm; however, it was difficult to manufacture curled cords with a curl length of less than 180 mm with the materials shown in Nos. 3 to 5 of Table 2.

Example 4

All of the curled cords described below were prepared and examined for appearance (setting property), stretchability, and restorability to the original configuration; also, after an aging-by-heat test, the insulating layer and the sheath layer were evaluated for deterioration. The results are shown in Table 3.

Also, for comparison, combinations of materials that are not included in this invention were used to prepare curled cords under the same conditions. The properties of these curled cords were evaluated and the results are shown in Table 3 as Comparative Examples.

As the conductor, copper wires twisted together to give the outer diameter of 0.8 mm were used, and the insulating polymer shown in Table 3 was extruded at 250° C. to form an insulating layer around the conductor. The thickness of the insulating layer was 0.5 mm. Core wires were obtained in this way. Next, the polymer sheath material shown in Table 3 was extruded to form a sheath layer around the insulated core wires. The thickness of the sheath layer was 1.0 mm. This cord was wound so that it touched itself with neighboring loops around a mandrel with an outer diameter five times that of the diameter of the cord, and curling was imparted to the cord by its being heated at 150° C. for 30 minutes.

The cord was cooled to room temperature while still being wound around the mandrel, and then the mandrel was removed. The appearance of the curled cord was examined (whether the inner diameter of the curled cord was set to the outer diameter of the mandrel; and whether there were spaces between the loops of the cord).

When the inner diameter of the curled cord was not larger than the outer diameter of the mandrel by 2% or more, and when there were no spaces between the loops of the cord lying next to each other, the setting property was evaluated to be good. In other cases, the setting property was evaluated to be poor. Next, when both ends of the curled cord were pulled, if there was no adhesion between adjacent loops of the cord, and if the curled cord stretched uniformly and smoothly, the stretchability was evaluated to be good. If there were other phenomena during stretching, the stretchability was evaluated to be poor.

This curled cord was stretched to five times the natural length $l_0$ at 50° C., held in that position for 10 minutes, and examined for its return to the original configuration by having its length l measured 5 seconds after being released. When $[(l-l_0)/l_0]\times 100$ was less than 2.0, the restorability to the original configuration was evaluated to be good. When this value was 2.0 or more, the restorability to the original configuration was evaluated to be poor.

Also, this curled cord was heated for 10 days in an oven at 100° C. The insulating layer and sheath layer were removed, and their retention rate of strength and retention rate of stretchability were investigated. When the retention rate of strength and the retention rate of stretchability of the insulating layer and the sheath layer were both 95% or more, the heat-resistance was evaluated to be good; when these values were less than 95%, the heat-resistance was evaluated to be poor.

When the volume specific resistivity of the insulating layer was $10^{13}\Omega$.cm or more, the insulating property was evaluated to be good. When this value was less than $10^{13}\Omega$.cm, the insulating property was evaluated to be poor.

TABLE 3

| | Insulating layer/ Sheath layer | Properties of curled cords: Setting property | Stretchability | Restorability | Heat-resistance | Insulating property |
|---|---|---|---|---|---|---|
| Examples | Polyester copolymer 1/Polyether · ester copolymer 1 | good | good | good | good | good |
| | Polyester copolymer 2/Polyether · ester copolymer 1 | good | good | good | good | good |
| | Polyester copolymer 3/Polyether · ester copolymer 2 | good | good | good | good | good |
| | Polyester copolymer 4/Polyether · ester copolymer 2 | good | good | good | good | good |
| Comparative Examples | Polybutylene terephthalate · ester copolymer 1 | poor | good | good | good | good |
| | Polyethylene terephthalate · ester copolymer 1 | poor | good | good | good | good |
| | Polyethylene naphthalate/Polyether · ester copolymer 2 | poor | good | good | good | good |
| | Polyether ester copolymer 1/Polyether · ester copolymer 2 | good | good | good | poor | poor |
| | Polyester copolymer 1/Polyvinyl chloride | good | good | good | poor | good |
| | Polyamide elastomer/Polyether · ester copolymer 2 | good | good | good | good | poor |

| Note: | Composition | Shore D hardness | Melting point (°C.) |
|---|---|---|---|
| Polyester copolymer 1 | PBT copolymer containing 10 mol % hexanediol | 78 | 210 |
| Polyester copolymer 2 | PBT copolymer containing 15 wt % polyactone | 70 | 215 |
| Polyester copolymer 3 | PET copolymer containing 20 mol % isophthalic acid | 75 | 215 |
| Polyester copolymer 4 | PEN copolymer containing 20 mol % orthophthalic acid | 73 | 230 |
| Polyether · ester copolymer 1 | PBT copolymer containing 40 wt % PTMG | 45 | 200 |
| Polyether · ester copolymer 2 | PET copolymer containing 60 wt % PTMG | 36 | 170 |
| Polybutylene terephthalate (PBT) | Homopolymer | 84 | 228 |
| Polyethylene terephthalate (PET) | Homopolymer | 86 | 255 |
| Polyethylene naphthalate (PEN) | Homopolymer | 86 | 280 |
| Polyvinyl chloride | Soft PVC containing 45 wt % plasticizer | 25 | — |
| Polyamide elastomer | NY12 copolymer containing 20 wt % PTMG | 62 | 175 |

Example 5

The materials described in the note of Table 4 were used to produce various curled cords in the same way as in Example 4. Table 4 shows the results of the evaluation of their properties, wherein the heat-resistance of the curled cords was evaluated as follows:

Each of the curled cords was heated for 10 days in an oven at 140° C.; thereafter, the insulating layer and sheath layer were removed, and their retention rate of strength was investigated. When the retention rate of strength of the insulating layer and the sheath layer was 70% or more, the heat-resistance was evaluated to be good; when this value was less than 70%, the heat-resistance was evaluated to be poor.

TABLE 4

| | Insulating layer/ Sheath layer | Properties of curled cords: Setting property | Stretchability | Restorability | Heat-resistance | Insulating property |
|---|---|---|---|---|---|---|
| Examples | Polyester copolymer 1/Mixture 1 | good | good | good | good | good |
| | Polyester copolymer 2/Mixture 1 | good | good | good | good | good |
| | Polyester copolymer 3/Mixture 2 | good | good | good | good | good |
| | Polyester copolymer 4/Mixture 2 | good | good | good | good | good |
| Comparative Examples | Polyester copolymer 1/Polyether · ester copolymer 1 | good | good | good | good | poor |
| | Polyester copolymer 1/Polyether · ester copolymer 2 | good | good | good | good | poor |
| | Polyester copolymer 2/Polyether · ester copolymer 1 | good | good | good | good | poor |
| | Polyester copolymer 2/Polyether · ester copolymer 2 | good | good | good | good | poor |
| | Polyester copolymer 1/Polyvinyl chloride | good | good | good | poor | poor |

| Note: | Composition | Shore D hardness | Melting point(°C.) |
|---|---|---|---|
| Polyester copolymer 1 | PBT copolymer containing 10 mol % hexanediol | 78 | 210 |
| Polyester copolymer 2 | PBT copolymer containing 15 wt % polylactone | 70 | 215 |
| Polyester copolymer 3 | PET copolymer containing 20 mol % isophthalic acid | 75 | 215 |
| Polyester copolymer 4 | PEN copolymer containing 20 mol % orthophthalic acid | 73 | 230 |
| Polyether · ester copolymer 1 | PBT copolymer containing 40 wt % PTMG | 45 | 200 |
| Polyether · ester copolymer 2 | Polyethylene terephthalate isophthalate (PETI) copolymer containing 20 wt % PTMG | 47 | 210 |
| Mixture 1 | 60/40 mixture of polyether · ester copolymer 1 and | 40 | 190 |

TABLE 4-continued

| | | | |
|---|---|---|---|
| | chlorinated PE (with the chloride content of 35 wt %) | | |
| Mixture 2 | 50/50 mixture of polyether · ester copolymer 2 and chlorinated PE (with the chloride content of 40 wt %) | 37 | 200 |
| Polyvinyl chloride | | 25 | — |

Example 6

The materials described in the note of Table 5 were used to produce various curled cords in the same way as in Example 4. Table 5 shows the results of the evaluation of their properties, wherein the heat-resistance of the curled cords was evaluated in the same way as in Example 5.

Example 7

The materials described in the note of Table 6 were used to produce various curled cords in the same way as in Example 4. Table 6 shows the results of the evaluation of their properties, wherein the heat-resistance of the curled cords was evaluated in the same way as in Example 5.

TABLE 5

| | Insulating layer/ Sheath layer | Properties of curled cords | | | | |
|---|---|---|---|---|---|---|
| | | Setting property | Stretchability | Restorability | Heat-resistance | Insulating property |
| Examples | Polybutylene terephthalate/Polyester · ester copolymer 1 | good | good | good | good | good |
| | PBT copolymer/Polyester · ester copolymer 1 | good | good | good | good | good |
| | Polyethylene terephthalate/Polyester · ester copolymer 2 | good | good | good | good | good |
| | Polyethylene naphthalate/Polyester · ester copolymer 2 | good | good | good | good | good |
| | PEN copolymer/Polyester · ester copolymer 2 | good | good | good | good | good |
| Comparative Examples | Polybutylene terephthalate/Polyether · ester copolymer 1 | poor | good | good | poor | good |
| | Polyethylene terephthalate/Polyether · ester copolymer 1 | poor | good | good | poor | good |
| | Polyethylene naphthalate/Polyether · ester copolymer 2 | poor | good | good | poor | good |
| | PBT copolymer/Polyether · ester copolymer 2 | poor | good | good | poor | good |
| | Polybutylene terephthalate/ Polyvinyl chloride | poor | good | good | poor | good |

| Note: | Composition | Melting point (°C.) |
|---|---|---|
| Polybutylene terephthalate (PBT) | | 228 |
| PBT copolymer | PBT copolymer containing 10 mol % hexanediol | 210 |
| Polyethylene terephthalate (PET) | | 255 |
| Polyethylene naphthalate (PEN) | | 280 |
| PEN copolymer | PEN copolymer containing 20 mol % orthophthalic acid | 230 |
| Polyester · ester copolymer 1 | PBT copolymer containing 40 wt % polybutylene adipate | 200 |
| Polyester · ester copolymer 2 | PET copolymer containing 15 wt % polylactone | 220 |
| Polyester · ester copolymer 1 | PBT copolymer containing 40 wt % PTMG | 200 |
| Polyether · ester copolymer 2 | PET copolymer containing 15 wt % PTMG | 218 |
| Polyvinyl chloride (PVC) | Soft PVC containing 45 wt % plasticizer | — |

TABLE 6

| | Insulating layer/ Sheath layer | Properties of curled cords | | | | |
|---|---|---|---|---|---|---|
| | | Setting property | Stretchability | Restorability | Heat-resistance | Insulating property |
| Examples | Block copolymer 1/Block copolymer 5 | good | good | good | good | good |
| | Block copolymer 2/Block copolymer 5 | good | good | good | good | good |
| | Block copolymer 3/Block copolymer 6 | good | good | good | good | good |
| | Block copolymer 4/Block copolymer 6 | good | good | good | good | good |
| Comparative Examples | Polybutylene terephthalate Block copolymer 5 | good | poor | good | good | good |
| | Polyethylene terephthalate Block copolymer 6 | poor | poor | good | good | good |
| | Block copolymer 1/Polyether · ester copolymer 1 | good | good | good | poor | good |
| | PBT copolymer/Block copolymer 5 | good | poor | good | good | good |
| | Block copolymer 1/Polyvinyl chloride | good | good | good | poor | good |

| Note: | Composition | Shore D hardness | Melting point (°C.) |
|---|---|---|---|
| Block copolymer 1 | PBT copolymer containing 20 wt % polylactone | 68 | 213 |
| Block copolymer 2 | PBT copolymer containing 15 wt % polylactone | 70 | 215 |
| Block copolymer 3 | PBT copolymer containing 10 wt % polylactone | 72 | 218 |
| Block copolymer 4 | PBT copolymer containing 20 wt % polybutylene adipate | 70 | 230 |
| Polybutylene terephthalate,(PBT) | | 84 | 228 |
| PBT copolymer | PBT copolymer containing 10 mol % hexanediol | 78 | 210 |

TABLE 6-continued

| | | | |
|---|---|---|---|
| Polyethylene terephthalate (PET) | 86 | 255 | |
| Block copolymer 5 | PBT copolymer containing 40 wt % polylactone | 46 | 198 |
| Block copolymer 6 | PBT copolymer containing 50 wt % polylactone | 40 | 195 |
| Polyether · ester copolymer 1 | PBT copolymer containing 40 wt % PTMG | 45 | 200 |
| Polyvinyl chloride | Soft PVC containing 45 wt % plasticizer | 25 | — |

Example 8

In this Example, the various kinds of curled cords mentioned below were prepared. These cords will be illustrated with references to FIGS. 5 to 8.

Figure 5:
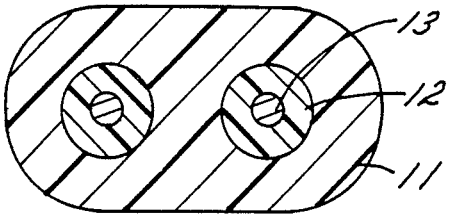
FIG. 5 is a sectional view of a curled cord described in Example 8 of the present invention.
Figure 8A:
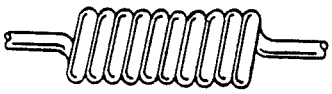
FIGS. 8A and 8B are schematic views of the curled cord shown in FIG. 5.
Figure 8B:
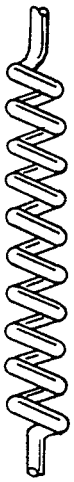

FIG. 5 is a sectional view of a curled cord prepared in this example. First, bare wires 13 made by the twisting together of thin wires of soft copper were covered with an insulating layer 12, which was made of R90AFR4 (a polyester.polyether block copolymer with an oxygen index of 26.0 and a modulus of impact resilience of 65%; available from Toyo Boseki K.K.). A silicone oil was applied to this insulated cord as a separating agent. After being dried, two of the cords were put together and covered with polyvinyl chloride (with an oxygen index of 28) to give a sheath layer 11. The covered cord obtained in this way was curled as shown in FIGS. 8A and 8B, giving the curled cord.

Figure 6:
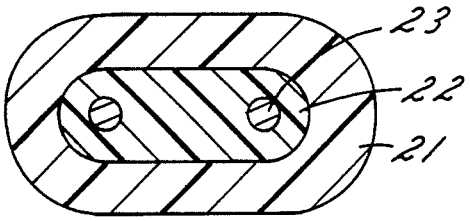
FIG. 6 is a sectional view of another curled cord described in Example 8 of the present invention.

FIG. 6 is a sectional view of another curled cord prepared in this example. First, bare wires 23 were covered with R90AFR3 (a thermoplastic polyester elastomer with an oxygen index of 25.5 and a modulus of impact resilience of 70%; available from Toyo Boseki K.K.) as an insulating layer 22. This insulated cord was covered with polyvinyl chloride (with an oxygen index of 33.0) to provide a sheath layer 21. The cord obtained in this way was curled to give a composite curled cord.

Figure 7:
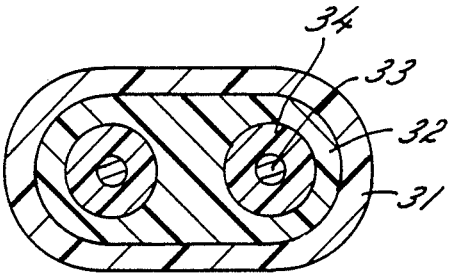
FIG. 7 is a sectional view of still another curled cord described in Example 8 of the present invention.

FIG. 7 is a cross-sectional view of still another curled cord prepared in this example. First, bare wires 33 (made by the twisting together of soft thin copper wires) was covered with S6001 of flame-resistance grade with excellent elasticity (a polyester.ester elastomer with an oxygen index of 25.0 and a modulus of impact resilience of 43.0%; available from Toyo Boseki K.K.) as an insulating layer 34. Two of the insulated cords were paired and covered with a protective layer 32 made of R90AFR4 (supra), and around this protected cord, a sheath layer 31 was formed of polytetrafluoroethylene (with an oxygen index of 85) covering it. The cord obtained in this way was curled to give a curled cord.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. An electrical conductor cord including a curled portion, said cord comprising at least one core wire and a sheath layer covering said core wire, said core wire having at least one conductor consisting essentially of at least one solid wire and covered with an insulating layer, said cord having a diameter of at least 1 mm when circular in cross-section, or a cross-sectional area of at least 1 $mm^2$ when non-circular in cross section, said insulating layer consisting essentially of crystalline copolyester selected from the group consisting of polyester-polyester block copolymer and polyester-polyether block copolymer, said polyester-polyester block copolymer comprising crystalline aromatic polyester segments and polylactone segments, said polyester-polyether block copolymer comprising crystalline aromatic polyester segments and aliphatic polyether segments, and said crystalline copolyester having a melting point of at least 180° C. and Shore D hardness of from 40 to 80, and wherein vertical stretch $L_0$ of the curled portion of said cord by its own weight is 30% or less and vertical stretch $L_{50}$ of the curled portion of said cord under a load of 50 g is at least 200%.

2. An electrical conductor cord according to claim 1 wherein said vertical stretch $L_0$ is 10% or less.

3. An electrical conductor cord according to claim 1, wherein said solid wires are selected from the group consisting of thin wires having a diameter of 0.1 mm or less, thin foil wires having a cross-sectional area of 0.01 $mm^2$ or less, and combinations thereof.

4. An electrical conductor cord according to claim 1, wherein said sheath layer consists essentially of polyester elastomer having Shore D hardness of 60 or less.

5. An electrical conductor cord according to claim 1, wherein said sheath layer is made of a composition comprising polyvinyl chloride and polyester elastomer, the proportion of said polyvinyl chloride being at least 50% by weight.

6. An electrical conductor cord according to claim 1, wherein said sheath layer consists essentially of a polyester elastomer composition having an oxygen index of at least 25.0, and said insulating layer consists essentially of a polyester elastomer composition having an oxygen index of at least 22.0 and a modulus of impact resilience of at least 30%.

7. An electrical conductor cord according to claim 1, wherein said sheath layer consists essentially of a composition of polyester elastomer and halogenated polyolefin.

8. An electrical conductor cord according to claim 1, wherein said insulating layer has a thickness of at least 0.1 mm and comprises a polyester block copolymer having a melting point of 180° C. to 240° C., and wherein said sheath layer has a thickness of at least 0.2 mm and comprises a polyester-polyether block copolymer having Shore D hardness of 60 or less.

9. An electrical conductor cord including a curled portion, said cord comprising at least one core wire and a sheath layer covering said core wire, said core wire having at least one conductor covered with an insulating layer, said cord having a diameter of at least 1 mm when circular in cross-section, or a cross-sectional area of at least 1 $mm^2$ when non-circular in cross section, said insulating layer consisting essentially of polyester-polyester block copolymer, and wherein vertical stretch $L_0$ of the curled portion of said cord by its own weight is 30% or less and vertical stretch $L_{50}$ of the curled portion of said cord under a load of 50 g is at least 200%.

10. An electrical conductor cord according to claim 9, wherein said sheath layer consists essentially of polyester elastomer having Shore D hardness of 60 or less.

11. An electrical conductor cord according to claim 9, wherein said sheath layer is made of a composition comprising polyvinyl chloride and polyester elastomer, the proportion of said polyvinyl chloride being at least 50% by weight.

12. An electrical conductor cord according to claim 9, wherein said sheath layer consists essentially of a polyester elastomer composition having an oxygen index of at least 25.0, and said insulating layer consists essentially of a polyester elastomer composition having an oxygen index of at least 22.0 and a modulus of impact resilience of at least 30%.

13. An electrical conductor cord according to claim 9, wherein said sheath layer consists essentially of a composition of polyester elastomer and halogenated polyolefin.

14. An electrical conductor cord according to claim 9, wherein said insulating layer has a thickness of at least 0.1 mm and comprises a polyester block copolymer having a melting point of 180° C. to 240° C., and wherein said sheath layer has a thickness of at least 0.2 mm and comprises a polyester-polyether block copolymer having Shore D hardness of 60 or less.

* * * * *